US006045451A

United States Patent [19]

Tsai

[11] Patent Number: 6,045,451

[45] Date of Patent: Apr. 4, 2000

[54] POCKET STRUCTURE OF A TABLE IN BILLIARDS

[76] Inventor: Chin-Ho Tsai, 11F-2, No. 43, Chai-I Street, Taichung, Taiwan

[21] Appl. No.: 09/273,959

[22] Filed: Mar. 22, 1999

[51] Int. Cl.[7] ..... A63D 3/00

[52] U.S. Cl. ..... 473/28

[58] Field of Search ..... 473/13, 18, 28, 473/32, FOR 13

[56] References Cited

U.S. PATENT DOCUMENTS

| | | | |
|---|---|---|---|
| 281,518 | 7/1883 | Kekenapp | 473/28 |
| 842,550 | 1/1907 | Houts | 473/28 |
| 1,116,890 | 11/1914 | Hobbs | 473/28 |
| 1,123,429 | 1/1915 | Johnson | 473/28 |
| 1,154,865 | 9/1915 | Jaeger | 473/28 |
| 3,944,224 | 3/1976 | Lalick | 473/28 |
| 4,544,156 | 10/1985 | Rasmussen et al. | 473/13 |

*Primary Examiner*—Jeanette Chapman
*Assistant Examiner*—Mitra Aryanpour
*Attorney, Agent, or Firm*—Charles E. Baxley, Esq.

[57] ABSTRACT

A pocket structure includes a first part having a ring body with a groove defined in the lower end thereof and a second part having a bottom with a periphery wall extending from the bottom. A flange extends from the top of the peripheral wall of the second part and is sized to be fitted into the groove. The ring body has a plurality of tapered lugs extending radially inward therefrom so that the flange slides over the tapered lugs and securely engaged with the groove.

5 Claims, 3 Drawing Sheets

POCKET STRUCTURE OF A TABLE IN BILLIARDS

FIELD OF THE INVENTION

The present invention relates to a pocket structure, and more particularly, to an improved pocket structure of a table in a billiards game and which is composed of a first part and a second part which has a flange securely engaged with a groove in the first part.

BACKGROUND OF THE INVENTION

A conventional pocket structure of the billiards table is shown in FIG. 1 wherein it is a one-piece member comprising of an engaging portion (1) which is a curved plate with a flange (11) extending radially outward from the top thereof, and a pocket portion (12) which has a U-shaped cross section with a plurality of holes (13) defined through the wall of the pocket portion (12). The pocket portion (12) is integrally connected to the curved plate so that it needs a large mold to manufacture the pocket. The pocket can only have one color which cannot meet the varion of customer needs.

The present invention intends to provide a pocket which is composed of two parts so that the shortcomings of the conventional pockets are resolved.

SUMMARY OF THE INVENTION

In accordance with one aspect of the present invention, there is provided a pocket structure comprising a first part having a ring body with a curved plate extending from the ring body. A first flange extends radially outward from the top of the curved plate and a second flange extends radially inward from the inside of the ring body. A third flange extends from the periphery of the second flange to define a first groove between the inside of the ring body and the third flange. A plurality of lugs extend radially inward from the inside of the ring body and located above the first groove.

A second part has a bottom and a periphery wall extending from the bottom. A fourth flange extends radially outward from the top of the second part and has a fifth flange extending from the periphery of the fourth flange so as to define a second groove between the fifth flange and the periphery wall of the second part. The first part is connected to the second part by engaging the fifth flange with the first groove and third flange with the second groove.

The main object of the present invention is to provide a pocket structure which is composed of two parts wherein the second part has a flange engaged with a groove in the first part.

Further objects, advantages, and features of the present invention will as become apparent from the following detailed description with appropriate reference to the accompanying drawings.

DETAILED DESCRIPTION OF THE PREFERRED EMBODIMENT

Figure 1:
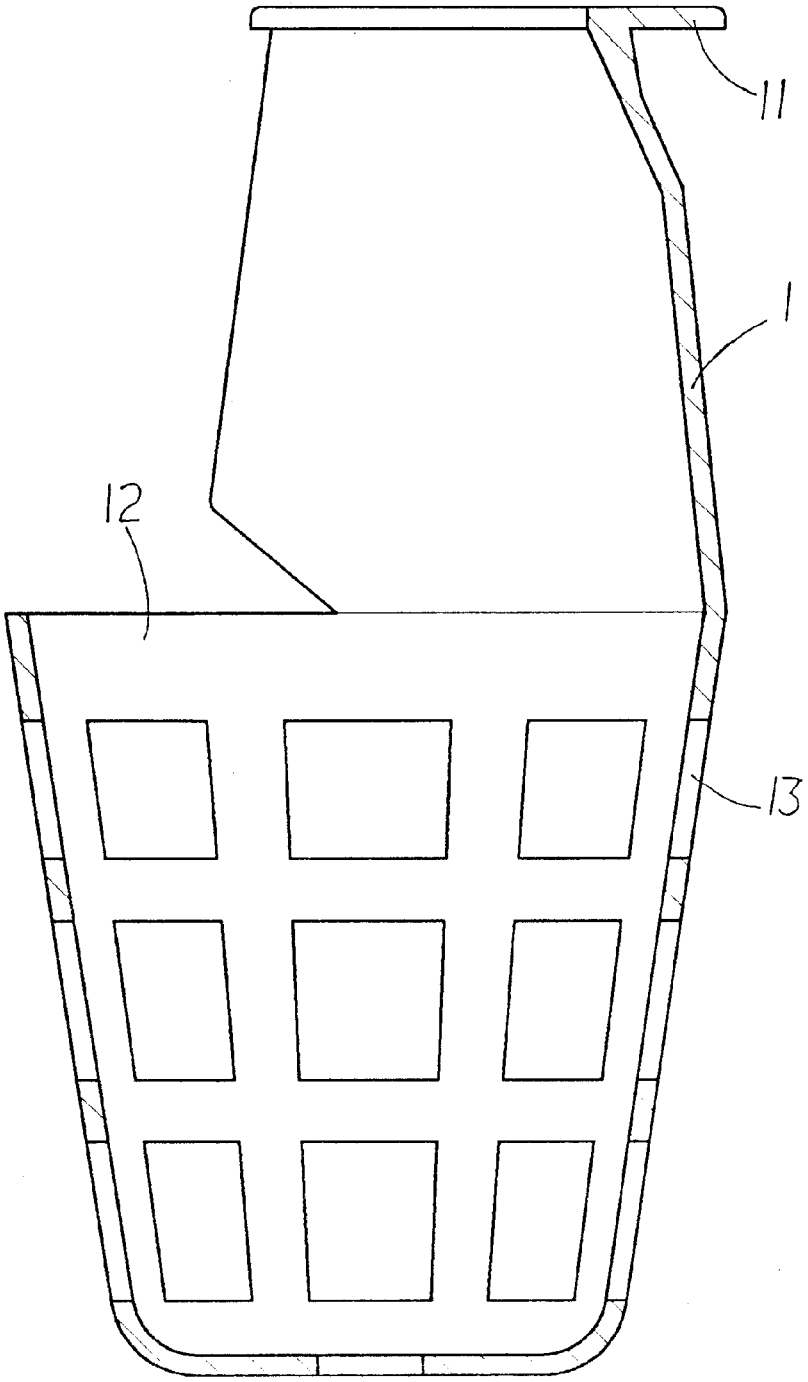
FIG. 1 PRIOR ART
FIG. 1 is a side elevational view, partly in section, of a conventional pocket.
Figure 2:
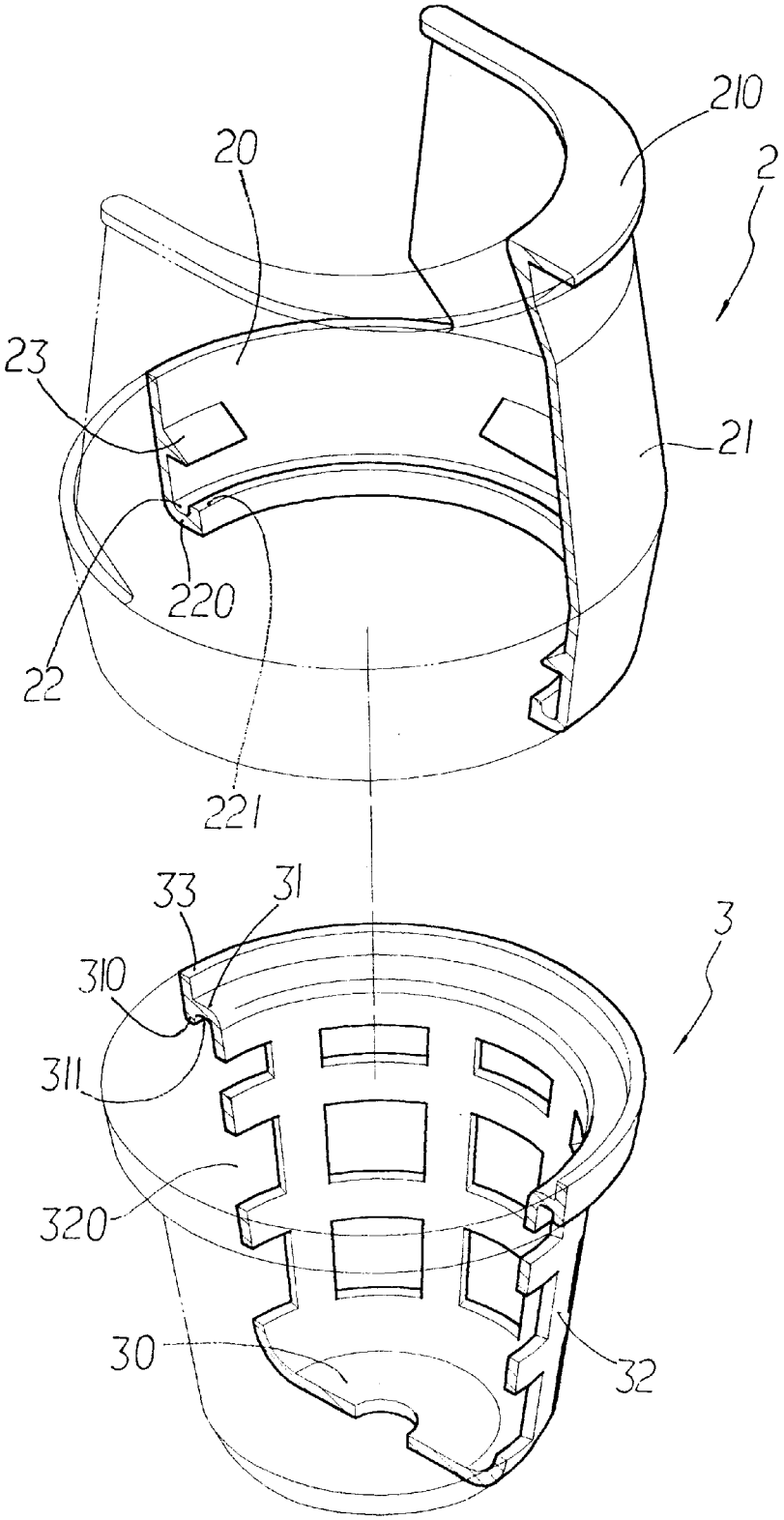
FIG. 2 is an exploded view of the pocket in accordance with the present invention.
Figure 4:
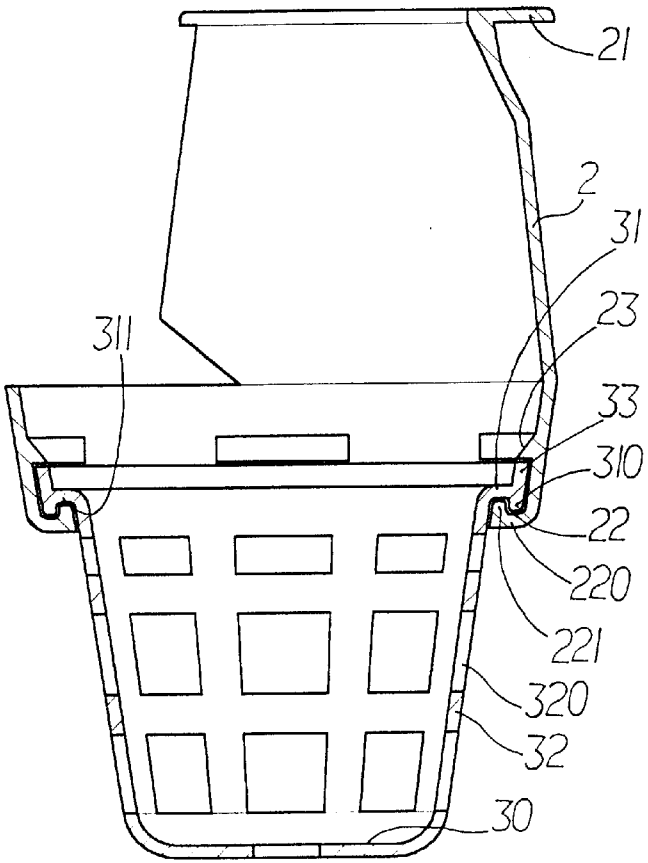
FIG. 4 is a side elevational view, partly in section, of the pocket in accordance with the present invention.
Figure 3:
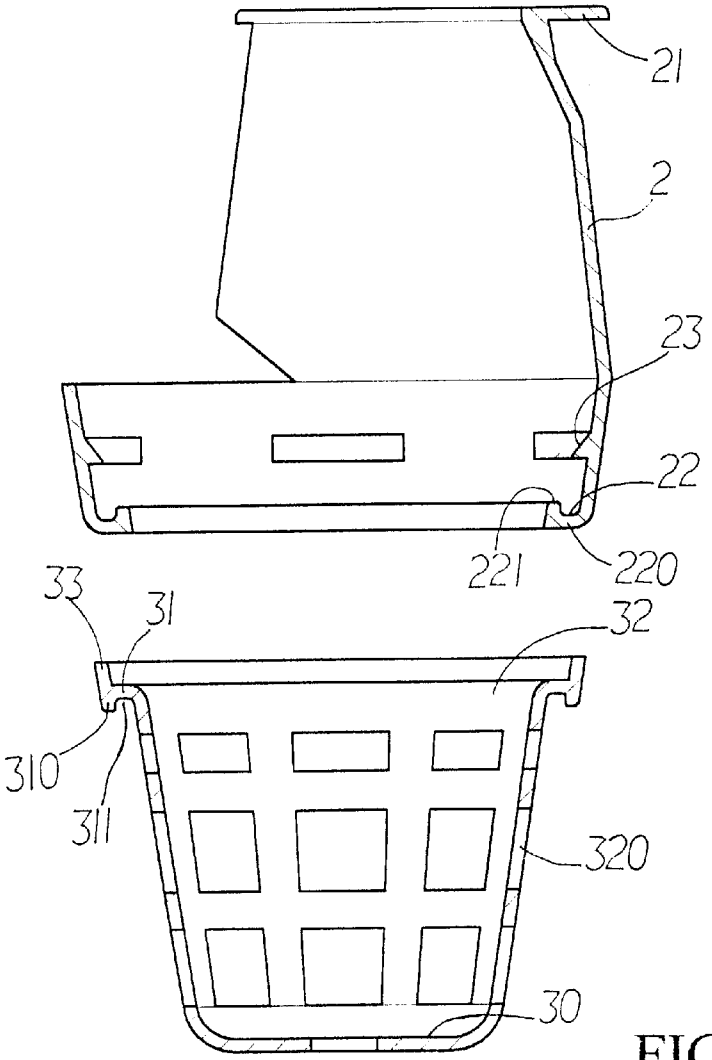
FIG. 3 is plan view to show the first part and the second part of the pocket in accordance with the present invention.

Referring to FIGS. 2 to 4, the pocket structure comprises a first part (2) having a ring body (20) with a curved plate (21) extending from the ring body (20) and a first flange (210) extending radially outward from the top of the curved plate (21). A second flange (220) extends radially inward from the inside of the ring body (20) and a third flange (221) extends from the periphery of the second flange (220) so as to define a first groove (22) between the inside of the ring body (20) and the third flange (221). A plurality of lugs (23) extend radially inward from the inside of the ring body (20) at an even interval and are located above the first groove (22). Each lug (23) has a tapered surface located on the side opposite to the first groove (22), and each lug (23) has a radial length less than the width of the first groove (22).

A second part (3) has a bottom (30) and a periphery wall (32) extending from the bottom (30). The periphery wall (32) has a plurality of holes (320) defined therethrough. A fourth flange (31) extends radially outward from the top of the second part (3) and has a fifth flange (310) extending from the periphery of the fourth flange (31) so as to define a second groove (311) between the fifth flange (310) and the periphery wall (32) of the second part (3). A ridge (33) extends from the fourth flange (31) and toward in opposite to the fifth flange (310). When connecting the first part (2) and the second part (3), the fifth flange (310) slides over the tapered surface of each lug (23) and is engaged with the first groove (22), while the third flange (221) is engaged with the second groove (311). The ridge (33) is sized to be received between the first groove (22) and the lugs (23). Therefore, the pocket is easily manufactured and assembled within a short time. Besides, the two parts (2, 3) are conveniently overlapped together so that the space they occupy is small. The color of the pocket is changeable according to the users' needs.

The invention is not limited to the above embodiment but various modification thereof may be made. It will be understood by those skilled in the art that various changes in form and detail may be made without departing from the scope and spirit of the present invention.

What is claimed is:

1. A billiards pocket structure comprising:

a first part (2) having a ring body (20) and a curved plate (21) extending from said ring body (20), a first flange (210) extending radially outward from the top of said curved plate (21), a second flange (220) extending radially inward from the inside of said ring body (20) and a third flange (221) extending from the periphery of said second flange (220) so as to define a first groove (22) between the inside of said ring body (20) and said third flange (221), a plurality of lugs (23) extending radially inward from the inside of said ring body (20) and located above said first groove (22), and a second part (3) having a bottom (30) and a periphery wall (32) extending from said bottom (30), a fourth flange (31) extending radially outward from the top of said second part (3) and having a fifth flange (310) extending from the periphery of said fourth flange (31)

so as to define a second groove (311) between said fifth flange (310) and said periphery wall (32) of said second part (3), said fifth flange (310) engaged with said first groove (22) and third flange (221) engaged with said second groove (311).

2. The billiards pocket structure as claimed in claim 1, wherein each lug (23) has a tapered surface located on the side opposite to said first groove (22).

3. The billiards pocket structure as claimed in claim 1, wherein each lug (23) has a radial length less than the width of said first groove (22).

4. The billiards pocket structure as claimed in claim 1, wherein said periphery wall (32) has a plurality of holes (320) defined therethrough.

5. The billiards pocket structure as claimed in claim 1 further comprising a ridge (33) extending from said fourth flange (31) and toward in opposite to said fifth flange (310), said ridge (33) sized to be received between said first groove (22) and said lugs (23).

* * * * *